US005594300A

United States Patent [19]

Nosker et al.

[11] Patent Number: 5,594,300

[45] Date of Patent: Jan. 14, 1997

[54] COLOR PICTURE TUBE HAVING A TENSIONED MASK AND COMPLIANT SUPPORT FRAME ASSEMBLY

[75] Inventors: Richard W. Nosker, Princeton; Joey J. Michalchuk, Lambertville, both of N.J.; Richard C. Bauder, Millersville; Frank R. Ragland, Jr., Lancaster, both of Pa.

[73] Assignee: Thomson Consumer Electronics, Inc., Indianapolis, Ind.

[21] Appl. No.: 558,315

[22] Filed: Nov. 15, 1995

[51] Int. Cl.[6] ..... H01J 29/80

[52] U.S. Cl. ..... 313/402; 313/404; 313/407; 313/408

[58] Field of Search ..... 313/402–408

[56] References Cited

U.S. PATENT DOCUMENTS

| | | | |
|---|---|---|---|
| 2,669,675 | 2/1954 | Lawrence | 315/22 |
| 3,030,536 | 4/1962 | Hackett et al. | 313/80 |
| 4,495,437 | 1/1985 | Kume et al. | 313/403 |
| 4,866,334 | 9/1989 | Fendley et al. | 313/407 |
| 4,994,712 | 2/1991 | Strauss | 313/405 |
| 5,053,674 | 10/1991 | Gismondo et al. | 313/407 |
| 5,214,349 | 5/1993 | Sakata et al. | 313/407 |

*Primary Examiner*—Sandra L. O'Shea
*Assistant Examiner*—Mack Haynes
*Attorney, Agent, or Firm*—Joseph S. Tripoli; Dennis H. Irlbeck

[57] ABSTRACT

The present invention provides an improvement in a color picture tube having a tensioned mask and support frame assembly. Each of the mask and the support frame is rectangular and has two long sides that parallel a central major axis thereof and two short sides that parallel a central minor axis thereof. The mask has a substantially cylindrical contour, being curved along the major axis and straight along the minor axis. The improvement comprises the frame including two first members that parallel the major axis and two second members, attached to the ends of the first members, that parallel the minor axis. Each of the first members includes a rigid section and a compliant section cantilevered from the rigid section. The mask is attached to the distal ends of the cantilevered compliant sections.

14 Claims, 4 Drawing Sheets

COLOR PICTURE TUBE HAVING A TENSIONED MASK AND COMPLIANT SUPPORT FRAME ASSEMBLY

This invention relates to color picture tubes having tensioned masks attached to support frames, and particularly to a tube with a mask-frame assembly having a tensioned mask that is attached to a compliant support frame.

BACKGROUND OF THE INVENTION

A color picture tube includes an electron gun for generating and directing three electron beams to a screen of the tube. The screen is located on the inner surface of a faceplate of the tube and is made up of an array of elements of three different color emitting phosphors. An apertured mask, which may be either a shadow mask or a focus mask, is interposed between the gun and the screen to permit each electron beam to strike only the phosphor elements associated with that beam. A shadow mask is a thin sheet of metal, such as steel, that is contoured to somewhat parallel the inner surface of the tube faceplate. A focus mask comprises dual sets of conductive lines that are perpendicular to each other and usually separated by an insulative layer.

One type of color picture tube has a cylindrical faceplate and a tensioned shadow mask mounted therein. In order to maintain the tension on the mask, the mask must be attached to a relatively massive support frame. Although such tubes have found wide consumer acceptance, there is still a need for further improvement in tube types having cylindrical faceplates, to reduce the weight and cost of the mask-frame assemblies in such tubes.

SUMMARY OF THE INVENTION

The present invention provides an improvement in a color picture tube having a tensioned mask and support frame assembly. Each of the mask and the support frame is rectangular and has two long sides that parallel a central major axis thereof and two short sides that parallel a central minor axis thereof. The mask has a substantially cylindrical contour, being curved along the major axis and straight along the minor axis. The improvement comprises the frame including two first members that parallel the major axis and two second members, attached to the ends of the first members, that parallel the minor axis. Each of the first members includes a rigid section and a compliant section cantilevered from the rigid section. The mask is attached to the distal ends of the cantilevered compliant sections.

DETAILED DESCRIPTION OF THE PREFERRED EMBODIMENTS

Figure 1:
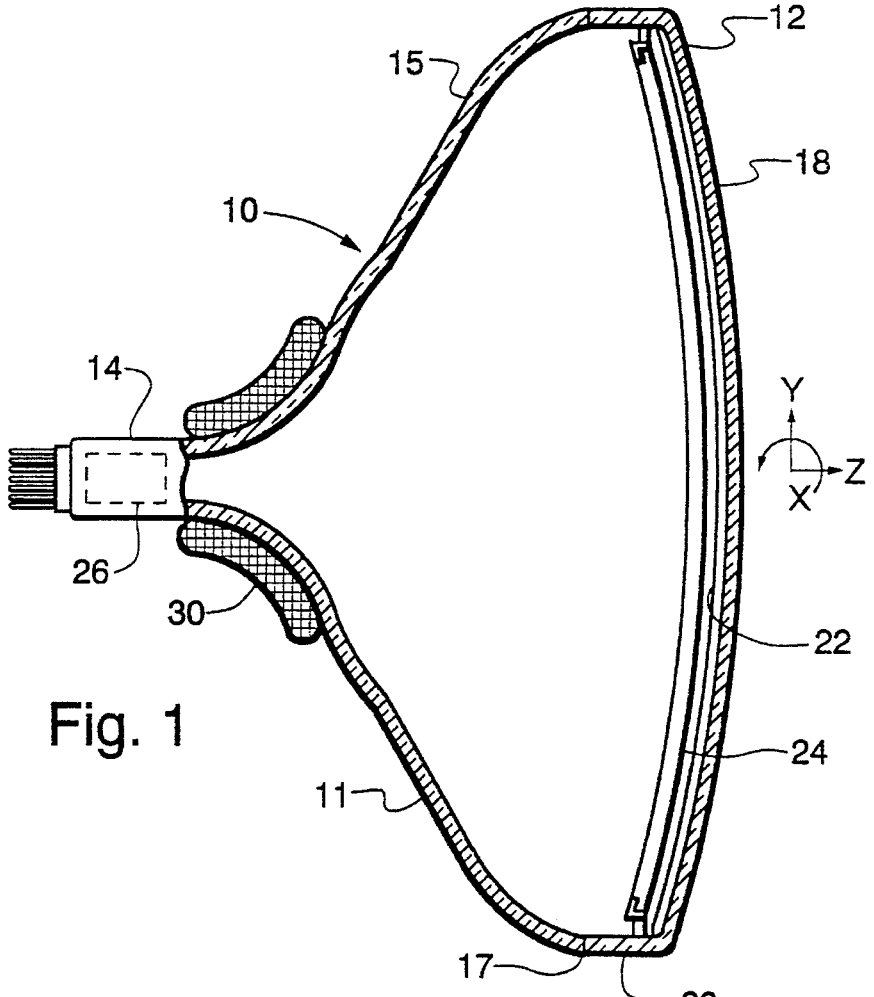
FIG. 1 is a top view, partly in axial section, of a color picture tube embodying the invention.
Figure 2:
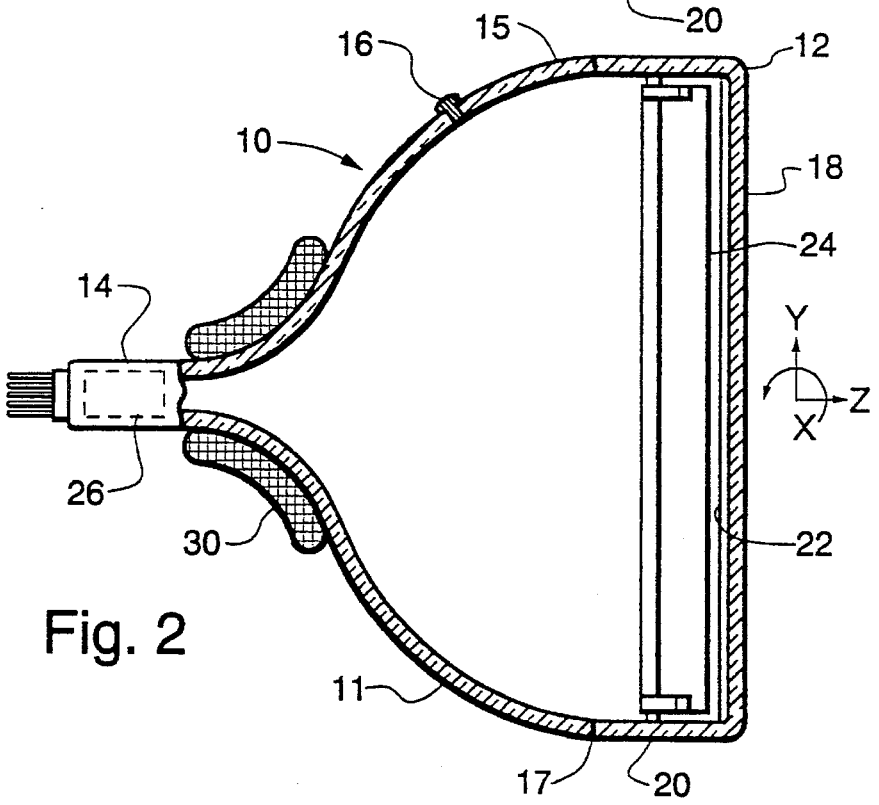
FIG. 2 is a side view, partly in axial section, of the color picture tube of FIG. 1.

FIGS. 1 and 2 show a color picture tube 10 having a glass envelope 11 comprising a rectangular faceplate panel 12 and a tubular neck 14 connected by a rectangular funnel 15. The funnel has an internal conductive coating (not shown) that extends from an anode button 16 to the neck 14. The panel 12 comprises a substantially cylindrical viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A substantially cylindrical multi-apertured color selection electrode or tensioned mask 24 is removably mounted in predetermined spaced relation to the screen 22. The color selection electrode or tensioned mask 24 may be either a shadow mask or a focus mask. An electron gun 26, shown schematically by dashed lines in FIGS. 1 and 2, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 3:
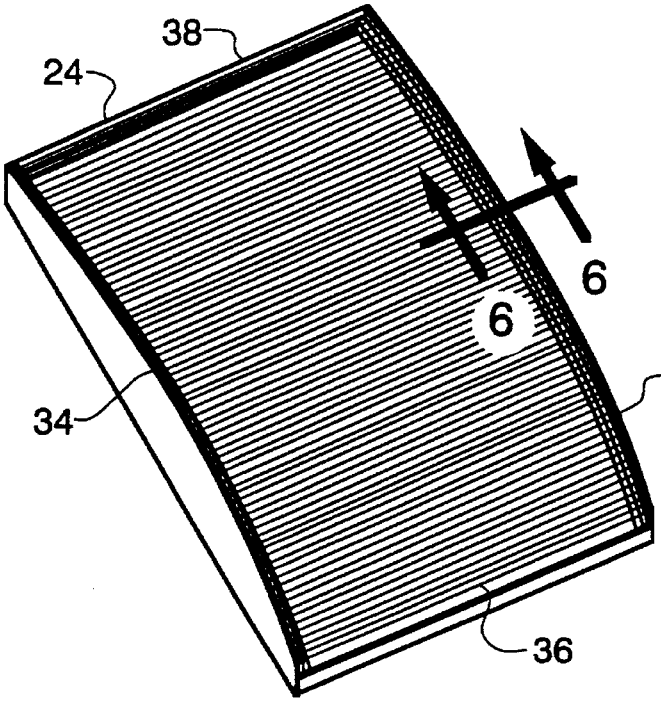
FIG. 3 is a perspective view of a tensioned shadow mask-frame assembly.
Figure 4:
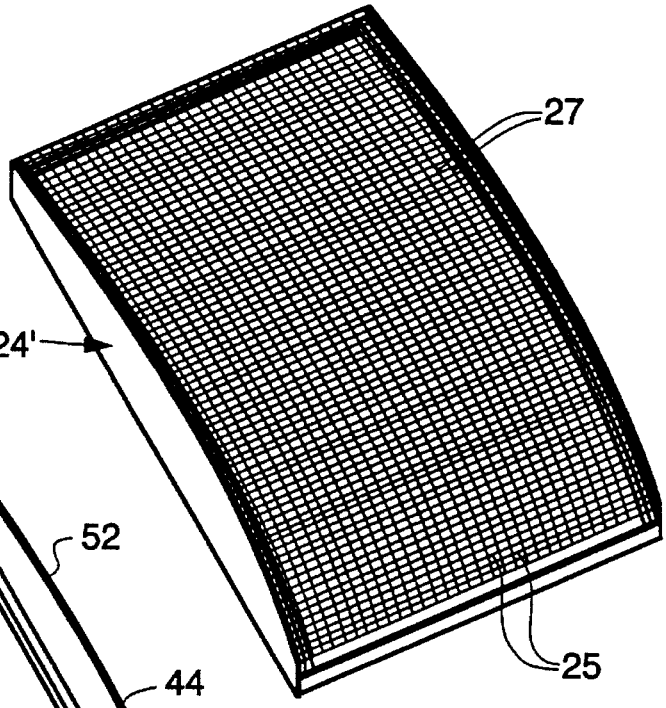
FIG. 4 is a perspective view of a tensioned focus mask-frame assembly.

The tensioned mask, shown in the form of a tensioned shadow mask 24' in FIG. 3, includes two long sides 32 and 34, and two short sides 36 and 38. The two long sides 32 and 34 of the mask parallel a central major axis, X, of the mask; and the two short sides 36 and 38 parallel a central minor axis, Y, of the mask. The tensioned shadow mask 24' of FIG. 3 includes an apertured portion that contains a multiplicity of elongated slits that parallel the minor axis of the mask. Each slit extends from near one long side of the mask to near the other long side. Another form of tensioned mask is a tensioned focus mask 24", shown in FIG. 4. The tensioned focus mask 24" includes dual sets of conductive lines 25 and 27 that are perpendicular to each other and separated by an insulative layer (not shown).

Figure 5:
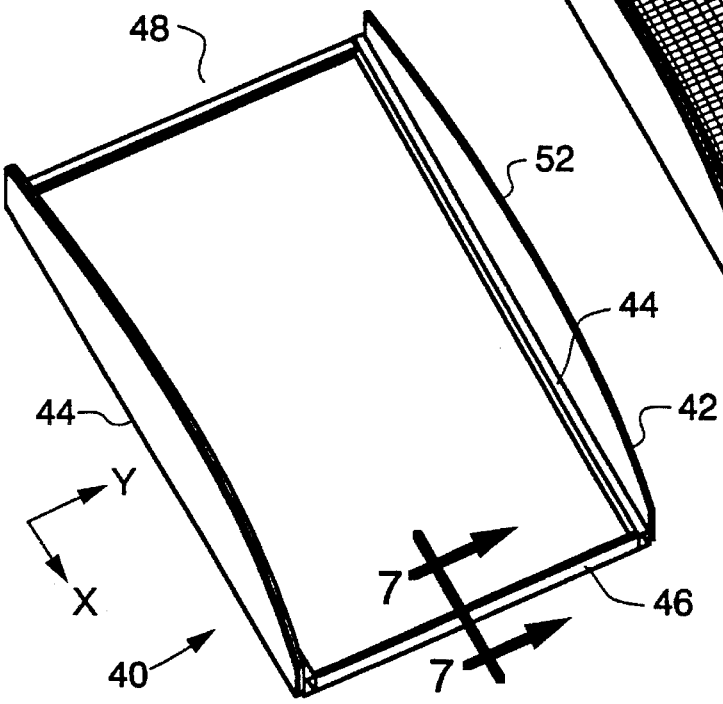
FIG. 5 is a perspective view of a mask frame.
Figure 6:
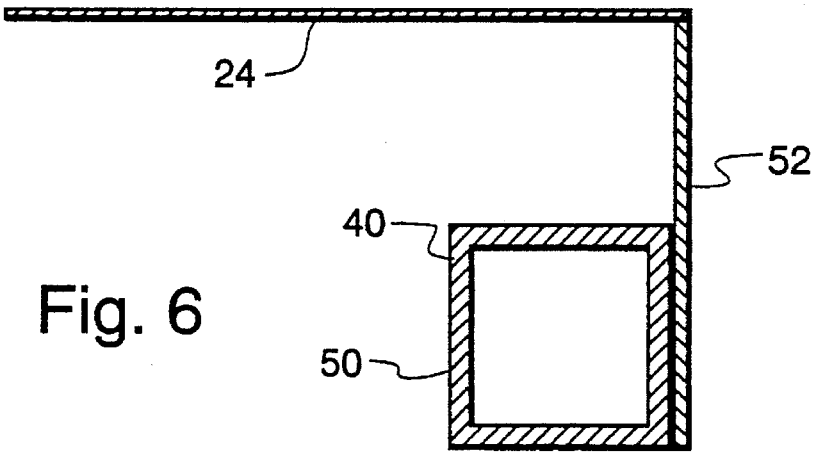
FIG. 6 is a partial cross-sectional view of the mask-frame assembly, taken at line 6—6 of FIG. 3.
Figure 7:
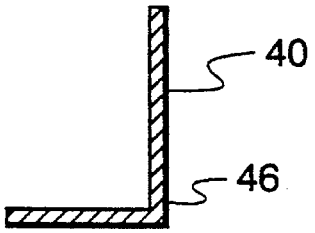
FIG. 7 is a partial cross-sectional view of the frame, taken at line 7—7 of FIG. 5.

A frame 40, for use with either a tensioned shadow mask or a tensioned focus mask, is shown in FIGS. 5, 6 and 7. The frame 40 includes four major members: two curved, long side members 42 and 44, substantially paralleling the major axis X of the tube, and two straight, short side members 46 and 48, paralleling the minor axis Y of the tube. Each of the two curved members 42 and 44 includes a rigid section 50 and a compliant section 52 cantilevered from the rigid section. The rigid sections 50 are hollow tubes, and the compliant sections 52 are metal plates. The compliant sections 52 vary in height (vertical dimension of section 52 in FIG. 5 and 6) from the center longitudinally to the ends of the sections to permit the best tension compliance over the mask. Each of the straight members 46 and 48 has an L-shaped cross-section. The two long sides of the mask 24 are welded to the distal ends of the compliant sections 52 of the two curved members 42 and 44.

In one preferred embodiment, the rigid sections 50 of the curved members 42 and 44 are hollow square tubes of 4130 steel having a wall thickness of 0.175 cm. The thickness of the compliant sections 52 is determined by considering mask thickness, the flexibility of the total mask-frame assembly and the desired warp misregistration limits. In a further preferred embodiment, the compliant sections 52 are plates of 302 stainless steel that are 0.157 cm thick. The compliant sections also can be bimetal plates, such as of stainless steel/stainless steel or stainless steel/Invar. The two straight members 46 and 48 are preferably of CRS-1018 steel having a thickness of 0.318 cm.

Figure 8:
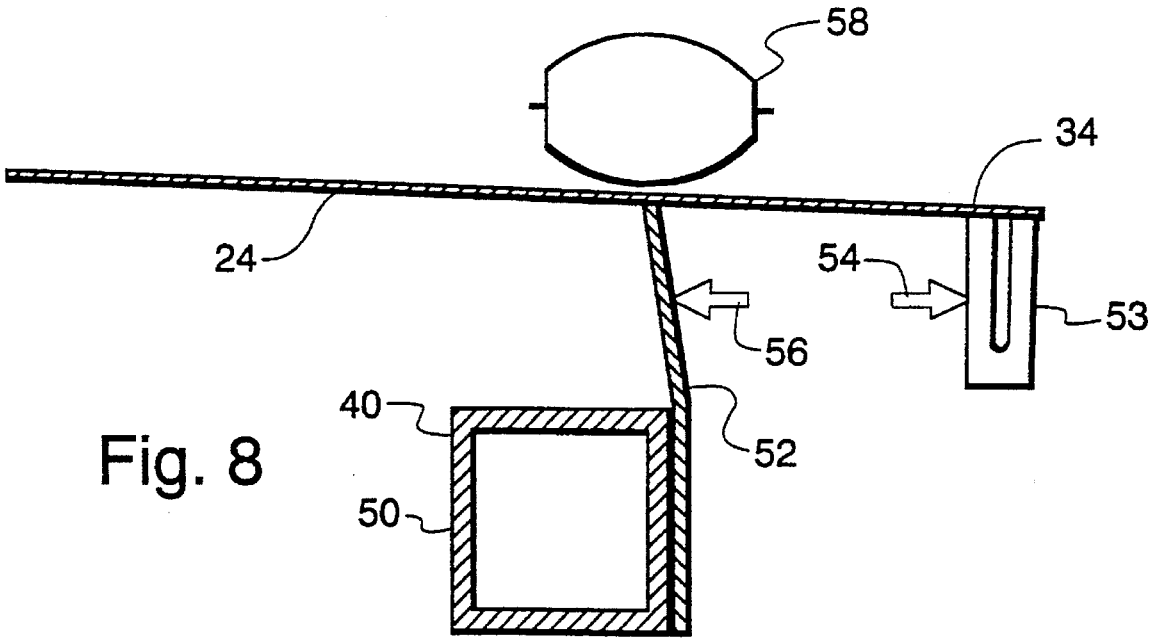
FIG. 8 is a partial cross-sectional view of a mask-frame assembly during fabrication.

A method of attaching the mask 24 (24' or 24") to the compliant sections 52 is shown in FIG. 8. First, the long sides 32 and 34 of the mask 24 are held by two vacuum supports 53 (one shown) that are moved apart, as shown by force vector 54, to put the mask under tension. At the same time, the compliant sections 52 are bent towards each other, as shown by force vector 56, with the distal ends of the compliant sections in contact with the mask. Next, a welding head 58 is moved along the mask 24, welding the mask to the distal ends of the compliant sections 52. Finally, the vacuum supports 53 are removed, and the excess portion of the mask is removed. The spring-back of the compliant sections 52, after removal of the force vector 56, maintains the mask under tension.

Figure 9:
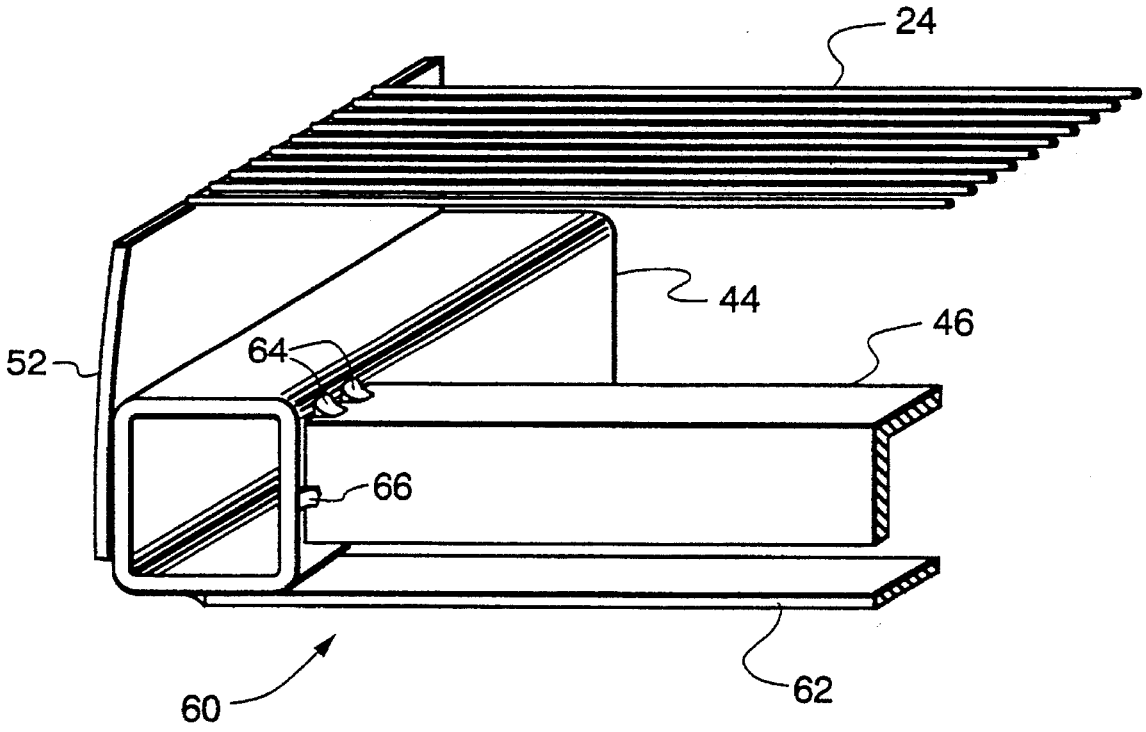
FIG. 9 is a partial perspective view of another mask-frame assembly.

Another preferred embodiment of a mask-frame assembly 60 is shown in FIG. 9. This assembly 60 is similar to the assembly shown in FIGS. 3 and 5, except for the inclusion of an additional member 62 on each short side of the frame and a change in the locations where the straight members 46 and 48 are welded to the curved members 42 and 44. Each additional member 62 is closely spaced from and parallel to a straight member 46 or 48 on a short side of the mask-frame assembly 60. At one end, the straight members 46 and 48 are welded to the curved member 42 at sufficient points to assure that they are rigidly attached. At the other end, the straight members 46 and 48 are welded to the curved member 44 as shown in FIG. 9, i.e., at several points 64 at the top of the straight member 46 and at only one point 66 along the side of the straight member 46. This connection permits some degree of flexibility around the weld points 64 as the pivots. The additional members 62 are firmly welded to the bottoms of both of the curved members 42 and 44. Preferably, the additional members 62 are of 300 Series stainless steel, which has a different coefficient of thermal expansion than does the CRS-1018 steel of the straight members 46 and 48. When the assembly 60 is heated, the additional members 62 expand more than do the straight members 46 and 48. Because of the flexible connections between the straight and curved members, the differential expansion between the additional members 62 and the straight members 46 and 48 relieves stress in the compliant sections 52 and tension in the mask 24.

Figure 10:
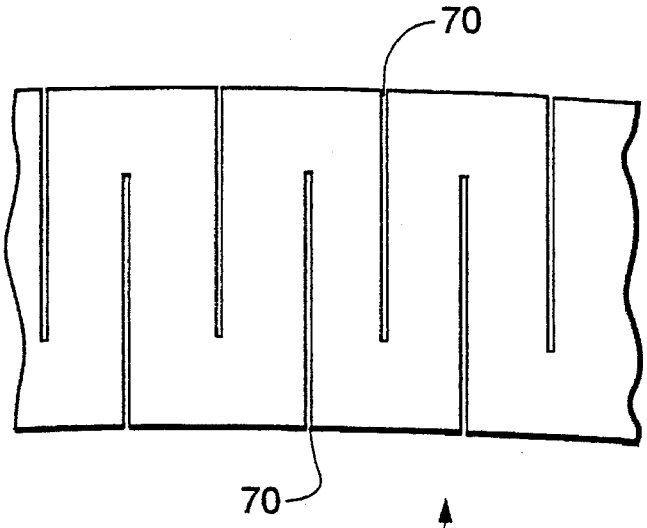
FIG. 10 is a partial plan view of a compliant section of a frame with interdigitated portions.

A modified compliant section 68 is shown in FIG. 10. The modified compliant section 68 includes narrow slots 70 (e.g., 0.33 mm in width) that are cut into the section from both the top and bottom thereof in an interdigitated manner. This interdigitated structure helps to minimize a wrinkling that tends to occur in the mask because of a thermal expansion mismatch between the compliant section material and the mask material.

Although the rigid sections 50 have been shown as hollow square tubes, other preferred configurations, such as those having L-shaped, C-shaped or triangular-shaped cross-sections, are also possible for these section. Furthermore, although the straight members 46 and 48 have been shown as having L-shaped cross-sections, other preferred configurations may be C-shaped, triangular shaped or box-shaped.

What is claimed is:

1. In a color picture tube having a tensioned mask and support frame assembly, each of said mask and said support frame being rectangular and having two long sides paralleling a central major axis thereof and two short sides paralleling a central minor axis thereof, said mask having a substantially cylindrical contour, being curved along said major axis and straight along said minor axis, the improvement comprising said frame including two first members paralleling the major axis and two second members, attached to the ends of said first members, paralleling the minor axis, each of said first members having a rigid section and a compliant section cantilevered from said rigid section, and said mask being attached to the distal ends of said compliant sections.

2. The color picture tube as defined in claim 1, wherein the height of said cantilevered compliant section varies from the center to the ends thereof.

3. The color picture tube as defined in claim 1, wherein said rigid section has a hollow box-shaped cross-section.

4. The color picture tube as defined in claim 1, wherein said second members have L-shaped cross-sections.

5. The color picture tube as defined in claim 1, wherein said tensioned mask is a shadow mask.

6. The color picture tube as defined in claim 1, wherein said tensioned mask is a focus mask.

7. The color picture tube as defined in claim 1, including two additional members spaced from and parallel to said two second members, said additional members being attached to the ends of said first members, and said additional members being of a material having a different coefficient of thermal expansion than that of said second members.

8. The color picture tube as defined in claim 1, wherein said cantilevered compliant section has slots therein, along the distal and proximal ends thereof, that form interdigitated portions of said compliant section.

9. In a color picture tube having a tensioned mask and support frame assembly, each of said mask and said support frame being rectangular and having two long sides paralleling a central major axis thereof and two short sides paralleling a central minor axis thereof, said mask having a substantially cylindrical contour, being curved along said major axis and straight along said minor axis, the improvement comprising said frame including two first members paralleling the major axis and two second members, attached to the ends of said first members, paralleling the minor axis, each of said first members having a rigid section and a compliant section cantilevered from said rigid section, said mask being attached to the distal ends of the compliant sections, two additional members spaced from and parallel to said two second members, said additional members being attached to the ends of said first members, and said additional members being of a material having a different coefficient of thermal expansion than that of said second members, and said cantilevered compliant sections having slots therein, along the distal and proximal ends thereof, that form interdigitated portions of said compliant sections.

10. The color picture tube as defined in claim 9, wherein said tensioned mask is a shadow mask.

11. The color picture tube as defined in claim 9, wherein said tensioned mask is a focus mask.

12. In a color picture tube having a tensioned mask and support frame assembly, each of said mask and said support frame being rectangular and having two long sides paralleling a central major axis thereof and two short sides paralleling a central minor axis thereof, said mask having a substantially cylindrical contour, being curved along said major axis and straight along said minor axis, the improvement comprising said frame including two first members paralleling the major axis and two second members, attached to the ends of said first members, paralleling the minor axis, each of said first members having a rigid section and a compliant section cantilevered from said rigid section, said mask being attached to the distal ends of the compliant sections, the heights of said cantilevered compliant sections varying from the centers to the ends thereof, said rigid sections having hollow cross-sections, and said second members having L-shaped cross-sections.

13. The color picture tube as defined in claim 12, wherein said tensioned mask is a shadow mask.

14. The color picture tube as defined in claim 12, wherein said tensioned mask is a focus mask.

* * * * *